United States Patent [19]

Smith

[11] 4,170,837

[45] Oct. 16, 1979

[54] HAMMER ACTION OF A REVOLVER

[76] Inventor: Leon Smith, P.O. Box 773, Redding, Calif. 96001

[21] Appl. No.: 893,253

[22] Filed: Apr. 5, 1978

[51] Int. Cl.[2] ..... F41C 1/00

[52] U.S. Cl. ..... 42/65

[58] Field of Search ..... 42/65

[56] References Cited

U.S. PATENT DOCUMENTS

| | | | |
|---|---|---|---|
| 100,227 | 2/1870 | White | 42/65 |
| 778,500 | 12/1904 | Mossberg | 42/65 |
| 1,004,172 | 9/1911 | Johnson | 42/65 |
| 1,046,268 | 12/1912 | Cobb | 42/65 |
| 1,972,763 | 9/1934 | Dutton | 42/65 |
| 3,548,530 | 12/1970 | Rohm | 42/65 |
| 3,701,213 | 10/1972 | Lewis | 42/65 |

FOREIGN PATENT DOCUMENTS

| | | | |
|---|---|---|---|
| 10072 | 5/1905 | United Kingdom | 42/65 |

OTHER PUBLICATIONS

"Redding Invention Attracts Attention", *Times/Outlook,* Sep. 21, 1977, p. 27.

"Firing Line–Coil Spring for S & W", *Gun World,* Sep. 1977.

*Primary Examiner*—Charles T. Jordan

[57] ABSTRACT

A helical spring for actuating the hammer of a revolver is combined with a link in the form of an angle bracket in a manner such that the pull on the trigger is minimized and at the same time held constant throughout its travel. The combination is constructed and adapted for ready conversion of hammer mechanisms of existing revolvers.

2 Claims, 3 Drawing Figures

HAMMER ACTION OF A REVOLVER

BACKGROUND OF THE INVENTION

The pulling of the trigger of firearms of the revolver type to effect operation of the hammer for accurate firing of the weapon has presented a problem for many years. This is especially true when preliminary cocking of the hammer is not resorted to, as in the case of police work. The relative high pressure or force required to pull or squeeze the trigger results in the deflection of the weapon off to one side and impairs the accuracy of the shooting.

Many improved mechanisms for this purpose are found in the prior art. Those currently known to applicant are set forth below.

Stern, U.S. Pat. No. 845,274 utilizes a helical spring in tension against the hammer, the latter being pivoted to make this possible. This was practicable in an old style revolver, circa 1907, when this patent issued.

Lisle, U.S. Pat. No. 970,248 utilizes a helical spring especially adapted to operate the mechanism for improved utilization of the explosive charge.

Leggett, et al, U.S. Pat. No. 1,007,709 uses a helical spring in combination with a novel and rather complicated mechanism for improved action of the hammer relative to the barrel. This is in combination with a rather complicated trigger mechanism.

Johnson, U.S. Pat. No. 1,004,172 appears to be closest in appearance to applicant's invention, but is significantly different and does not perform the function which applicant does as set forth below.

Cobb, U.S. Pat. No. 1,046,268 is merely an improvement on the Johnson patent cited above.

Johansson, U.S. Pat. No. 1,586,810 is comprised of a helical spring which performs a routine function and the novely lies in the longitudinal rather than the pivotal action of the trigger.

Miller, U.S. Pat. No. 3,055,270. This likewise teaches a helical spring in connection with an automatic revolver having recoiling cylinder frame.

Rohm, U.S. Pat. No. 3,548,530. The spring action here is similar to the other patents cited where the hammer and trigger are pivotally mounted on one side of a cover plate.

Baker, U.S. Pat. No. 3,733,730 teaches a rather elaborate mechanism for providing a constant trigger pull at all positions of the barrel.

Hillberg, et al, U.S. Pat. No. 3,810,326 uses a novel construction of sub-assemblies of which the spring is a component part.

Baker, U.S. Pat. No. 3,996,686 teaches a construction in which the helical spring is part of a mechanism in which a gear segment is utilized for transmissions of the action of the trigger to the hammer.

All of the above prior art entails use of helical springs in various combinations. The helical springs are almost invariably used in combination with a concentric plunger sliding within the spring, the whole assembly being rigidly fixed at each end. No flexibility is provided. Their action is akin to that of a spring operated poppet valve. In every case the springs are fixed, at at least one end and sometimes at both ends.

It is known that the functioning of a helical spring is affected by the manner in which the ends are constrained, that is whether fixed or hinged. (See Kent's Mechanical Engineers' Handbook - 12th Edition pp. 11-14 to 11 - 15.)

The effect of lateral or transverse loading of helical springs is also understood although it is attended by rather complicated mathematical analysis so that emperical methods are usually employed to get the best spring action for a given application. (See A. M. Wahl, Mechanical Springs. Penton Publishing Company, Cleveland 1944.)

I am not aware of any attempts to basically improve the spring action of a revolver hammer before my improvement disclosed herein.

Some commercial revolvers utilize a leaf spring rather than a helical spring to provide the spring action necessary for operation of the hammer. A leaf spring does provide a certain amount of flexibility, overcomes some of the above disadvantages insofar as uniformity of force required to pull the trigger is concerned, but is disadvantageous in that it still requires a relatively hard pull on the trigger to operate the hammer, which pull is still far from uniform throughout its travel.

SUMMARY OF THE INVENTION

I have invented a mechanism which overcomes all of the above problems. It combines a helical spring with a link, the assembly being pivoted so that it could rotate about its opposite ends. This permits a motion of translation as well as compression of the spring. The results are to greatly decrease the pressure required to deflect the spring and to make this pressure uniform throughout the travel of the trigger.

My mechanism is so constructed as to make it readily adapted for installation in existing revolvers as a substitute for their present mechanisms, thus greatly improving the operation of these weapons.

DESCRIPTION OF A PREFERRED EMBODIMENT

Figure 1:
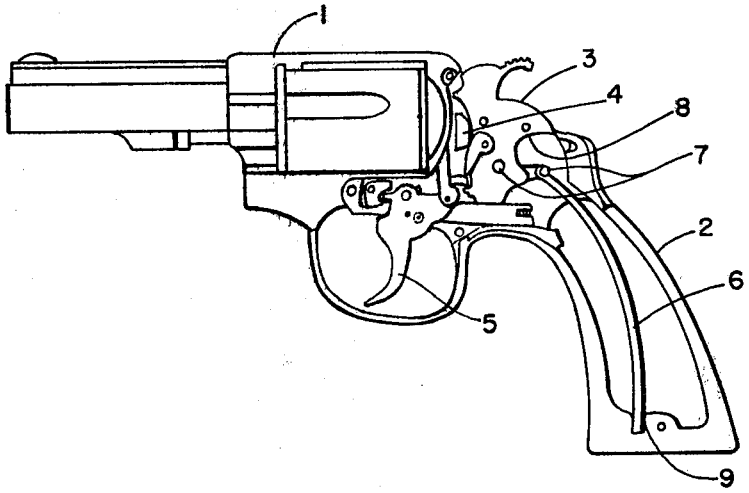
FIG. 1 is a side view of a revolver with the handle portion cut away showing a conventional leaf spring hammer action mechanism.

Referring now to the figures and particularly first to FIG. 1, there is seen the revolver frame 1 and handle 2. The hammer 3 is engaged by lifter 4 which connects with a conventional mechanism to trigger 5. Leaf spring 6 engages hammer 3 through guide pins 7. A recessed area of the back portion of the hammer is shown at 8 and a slot or groove in the bottom of the revolver handle for receiving the other end of spring 6 is shown at 9.

Figure 2:
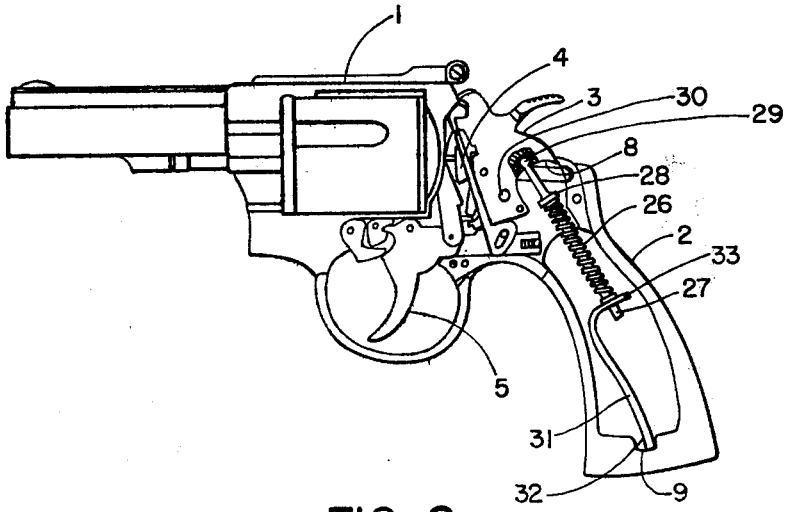
FIG. 2 is a side view of a revolver with the handle partly cut away showing my improved helical spring and link hammer action mechanism.
Figure 3:
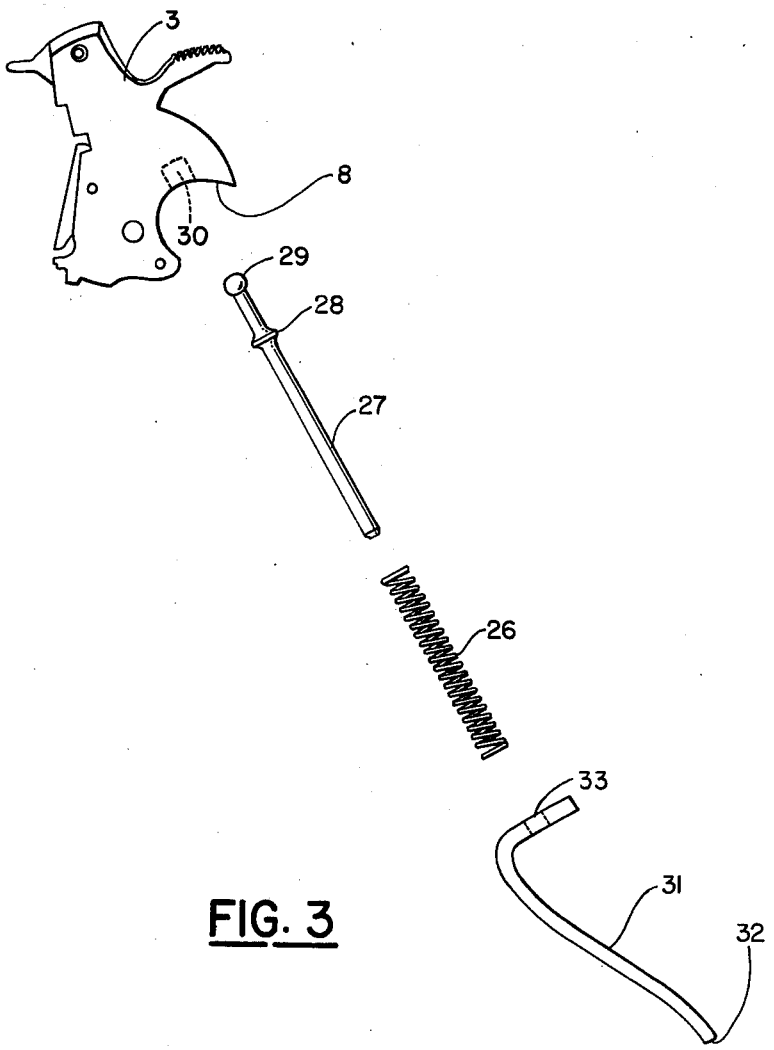
FIG. 3 is an exploded view showing the elements of my improved mechanism.

Referring now to FIG. 2, there is seen my new mechanism replacing the leaf spring of FIG. 1. The basic components of the revolver 1 through 9 are the same with the exception of the leaf spring 6 and pin guides 7. The new elements or components are shown in the exploded view in FIG. 3 and bear the same numbers as those of FIG. 2. These are as follows. Helical spring 26 is engaged by plunger 27. The latter has a collar 28 and a ball portion at one end 29. To adapt my new mechanism to the existing revolver it is merely necessary to drill a small hole 30 in the recessed portion 8 of the hammer to receive ball 29.

I next employ angle bracket 31 of partially arcuate configuration having a bottom end 32 and a hole 33. The hole 33 provides a loose fit for plunger 27. The end 32 abuts in a slot or recess 9 in the frame. In converting existing leaf spring mechanisms, this may be the slot previously occupied by the end of the leaf spring 6 as shown on FIG. 1. The slot 9, while confining bracket 31 to a fixed location in the weapon, permits a certain amount of angular motion or rotation. The angle bracket 31 thus performs a double function of acting as a seat for spring 26 and as a link member to provide a knee action for the entire mechanism. The combined motion of the ball and the plunger 27, helical spring 26, and angle bracket 31 is such as to produce the unusual and advantageous effect of reducing the pressure of pull required on trigger 5 and maintaining the latter uniform throughout its whole travel.

I have not been able to demonstrate mathematically the performance of this mechanism by applying principles of analytical mechanics. This appears to be rather difficult to do, as mentioned above under BACKGROUND OF THE INVENTION. I have determined however, through empirical tests that the force required to pull a trigger of a 38 caliber revolver through its firing cycle is approximately one-half that required with the conventional hammer and spring mechanism and is uniform throughout the pull. This may be due to the fact that with my mechanism I get the combined action of compression of the helical spring with a motion of translation or flexure of the spring with the added feature of employing pivoted ends for my spring. The latter is effected by the motion of bracket 31 and ball and socket 29 and 30 respectively.

In none of the mechanisms for operating the hammer in the prior art cited is this feature present and since it appears to be an unusual and unexpected result, it is submitted, that it makes the mechanism as so claimed patentable over the prior art.

The further advantage of my mechanism as described herein is the ease with which it may be used to convert and hence improve the operation of existing revolvers. I have found it expedient to furnish my mechanism in packaged units with simple instructions to owners of revolvers, utilizing a leaf spring, who have found it to be extremely advantageous. This has produced a substantial amount of commercial success.

Although my mechanism was developed specifically for the latter purpose, it may, of course, be utilized in any revolver as will be evident to those skilled in the art.

I claim:

1. An improved mechanism for actuating a hammer of a revolver positioned within a handle frame thereof comprising:

a helical spring;

a plunger having one ball-shaped end positioned for slidable axial motion concentrically within said spring;

a collar positioned on said plunger adjacent said ball-shaped end disposed to engage the first end of said spring;

an angle bracket;

the first end of said bracket having a hole therethrough disposed to loosely engage said plunger;

said first end of said bracket being further disposed to engage the second end of said spring;

the second end of said bracket being disposed to pivotally engage the bottom of said handle frame;

said pivotal engagement being further disposed to permit rotation of said bracket about said pivot in the plane of said spring;

said ball-shaped end of said plunger being disposed to engage a socket in the hammer of said revolver;

whereby backward motion of said hammer produces a combined motion of compression and lateral flexing of said helical spring.

2. An improved mechanism for actuating a hammer of a revolver positioned within a handle frame thereof comprising:

a helical spring;

a plunger having one ball-shaped end positioned for slidable axial motion concentrically within said spring;

a collar positioned on said plunger adjacent said ball-shaped end disposed to engage the first end of said spring;

an angle bracket;

the first end of said bracket having a hole therethrough disposed to loosely engage said plunger;

said first end of said bracket being further disposed to engage the second end of said spring;

a slot in the bottom of the interior of said handle frame;

said slot being disposed to loosely engage the second end of said bracket permitting rotary movement of said bracket in the plane of said spring;

whereby backward motion of said hammer produces compression of said spring, rotation of said bracket and simultaneous lateral flexing of said spring.

* * * * *